US007891045B2

(12) United States Patent
Kim et al.

(10) Patent No.: US 7,891,045 B2
(45) Date of Patent: Feb. 22, 2011

(54) ROBOT CLEANER SYSTEM HAVING ROBOT CLEANER AND DOCKING STATION

(75) Inventors: Yong Tae Kim, Yongin-si (KR); Hoon Wee, Yongin-si (KR); Dong Won Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 63 days.

(21) Appl. No.: 12/071,583

(22) Filed: Feb. 22, 2008

(65) Prior Publication Data

US 2008/0201895 A1 Aug. 28, 2008

(30) Foreign Application Priority Data

Feb. 26, 2007 (KR) ..... 10-2007-0019128

(51) Int. Cl.
*A47L 9/28* (2006.01)

(52) U.S. Cl. ..... 15/319; 15/340.1; 15/328

(58) Field of Classification Search ..... 15/319, 15/339, 340.1, 328
See application file for complete search history.

(56) References Cited

U.S. PATENT DOCUMENTS 5,109,566 A * 5/1992 Kobayashi et al. ..... 15/319
6,076,226 A * 6/2000 Reed ..... 15/319
2005/0150519 A1 7/2005 Keppler et al.
2007/0157415 A1 * 7/2007 Lee et al. ..... 15/319

FOREIGN PATENT DOCUMENTS

| | | | |
|---|---|---|---|
| CN | 1575734 | | 2/2005 |
| ES | 2 238 196 | | 8/2005 |
| JP | 02-159233 | * | 6/1990 |
| JP | 2003-180587 | | 7/2003 |

OTHER PUBLICATIONS

Chinese Office Action for corresponding Chinese Application 200810080581.9; issued May 8, 2009.
European Search Report for corresponding European Application 08151359.0-2316; mailed Aug. 1, 2008.

* cited by examiner

*Primary Examiner*—Shay L Karls
(74) *Attorney, Agent, or Firm*—Staas & Halsey LLP

(57) ABSTRACT

Disclosed is a robot cleaner system having superior functions of sucking dust and exhausting dust to a docking station. The robot cleaner includes a dust suction port to suck dust, a dust collecting chamber to collect dust introduced through the dust suction port, a dust exhaust port to exhaust dust collected in the dust collecting chamber to the docking station, a connection path extending from the dust suction port to the dust exhaust port in adjacent to the dust collecting chamber, and a valve device provided between the connection path and the dust collecting chamber, an opening/closing of the valve device allowing the dust collecting chamber to selectively communicate with the dust suction port or the dust exhaust port according to a pressure difference between the dust collecting chamber and the connection path.

22 Claims, 4 Drawing Sheets

ROBOT CLEANER SYSTEM HAVING ROBOT CLEANER AND DOCKING STATION

CROSS-REFERENCE TO RELATED APPLICATIONS

This application claims the benefit of Korean Patent Application No. 10-2007-0019128, filed on Feb. 26, 2007, in the Korean Intellectual Property Office, the disclosure of which is incorporated herein by reference.

BACKGROUND

1. Field

The present invention relates to a cleaner. More particularly, the present invention relates to a robot cleaner system having a docking station used to remove dust by sucking the dust collected in a robot cleaner.

2. Description of the Related Art

A cleaner is an appliance that cleans a room by removing impurities from the room. In general, a vacuum cleaner that sucks impurities using suction force of a vacuum section is mainly used. Recently, a robot cleaner, which detects and removes impurities from a floor while moving along the floor according to an automatic traveling function, has been developed.

The robot cleaner constitutes a robot cleaner system together with a docking station, which is located in a predetermined place of a room to electrically charge the robot cleaner or to remove dust collected in the robot cleaner.

Such a robot cleaner system is disclosed in U.S. Published Application No. 2005-0150519. The robot cleaner system includes a robot cleaner and a docking station having a suction unit to suck dust. A suction port is formed at a lower portion of the robot cleaner to suck dust and a brush is rotatably installed in the suction port to brush dust from a floor. The docking station is provided with a support having an inclined surface to allow the robot cleaner to move onto the docking station. A suction port is formed at one side of the inclined surface to suck dust from the robot cleaner. Thus, when the robot cleaner reaches a docking position by moving along the inclined surface, the suction port of the robot cleaner faces the suction port of the docking station. Then, the suction unit operates to collect dust stored in the robot cleaner into the docking station.

However, according to the above robot cleaner system, the robot cleaner docks with the docking station after the robot cleaner has been placed on the inclined surface of the docking station having a predetermined height. Therefore, the docking operation of the robot cleaner is not easy. Thus, a complex structure is necessary to precisely guide the robot cleaner onto the docking position.

In addition, the structure of the support installed in the docking station is inadvantageous because the support interferes with the moving function of the docking station, so the docking station cannot be separately used as a manual cleaner.

In addition, since the above robot cleaner system sucks dust in a state in which the suction port of the robot cleaner faces the suction port of the docking station, a sealing state between the suction ports deteriorates, so that suction force of the suction unit is greatly wasted or dust being moved into the docking station may be dropped onto the floor of the room.

SUMMARY

Accordingly, it is an aspect of the present embodiment to provide a robot cleaner system including a robot cleaner having superior functions of sucking dust and exhausting dust to a docking station.

Another aspect of the present embodiment is to provide a robot cleaner system capable of easily performing a docking operation between a robot cleaner and a docking station.

Still another aspect of the present embodiment is to provide a robot cleaner system including a docking station, which is equipped with a moving function so that the docking station can be separately used as a manual cleaner.

Additional aspects and/or advantages will be set forth in part in the description which follows and, in part, will be apparent from the description, or may be learned by practice of the invention.

The foregoing and/or other aspects are achieved by providing a robot cleaner system including: a robot cleaner; and a docking station to receive dust collected in the robot cleaner, wherein the robot cleaner includes: a dust suction port to suck dust; a dust collecting chamber to collect dust introduced through the dust suction port; a dust exhaust port to exhaust dust collected in the dust collecting chamber to the docking station; a connection path extending from the dust suction port to the dust exhaust port in adjacent to the dust collecting chamber; and a valve device provided between the connection path and the dust collecting chamber, an opening/closing of the valve device allowing the dust collecting chamber to selectively communicate with the dust suction port or the dust exhaust port according to a pressure difference between the dust collecting chamber and the connection path.

The valve device may include a suction valve, which is opened when dust is sucked through the dust suction port, and an exhaust valve, which is opened when dust is exhausted through the dust exhaust port.

The robot cleaner system may further includes an air guide provided between the suction valve and the exhaust valve to define the dust collecting chamber and the connection path.

The exhaust valve may be provided at a lower portion of the dust collecting chamber, and the exhaust valve may be closed when a pressure of the dust collecting chamber is lower than a pressure of the connection path.

The suction valve may be closed when a pressure of the connection path is lower than a pressure of the dust collecting chamber.

The exhaust valve may include a first valve member having a first side rotatably fixed and a second side pivotably rotated toward the connection path to open/close a path between the connection path and the dust collecting chamber.

The suction valve may include a second valve member having a first side rotatably fixed by means of a pivot pin and a second side pivotably rotated toward the dust collecting chamber to open/close a path between the connection path and the dust collecting chamber. The path between the connection path and the dust collecting chamber may be opened in a normal state due to a weight thereof.

The path between the connection path and the dust collecting chamber may be closed in a normal state due to a weight thereof.

The robot cleaner may further include a valve unit that opens the dust exhaust port when the robot cleaner docks with the docking station.

The robot cleaner may further include a first dust box to collect dust, the dust collecting chamber, the connection path and the valve device being provided in the first dust box.

A check valve, which may be opened when a suction force is applied to the connection path, may be installed in the dust suction port to prevent dust from flowing back, and the check valve may include a third valve member, an upper portion of the third valve member being rotatably fixed so that the third valve member is able to close the dust suction port due to a weight thereof.

The foregoing and/or other aspects are achieved by providing a robot cleaner system including: a robot cleaner having a first dust box to collect dust; and a docking station to receive dust collected in the robot cleaner, wherein the first dust box includes: a dust suction port to suck dust; a dust collecting chamber to collect dust introduced through the dust suction port; a dust exhaust port to exhaust dust collected in the dust collecting chamber to the docking station; a connection path extending from the dust suction port to the dust exhaust port in adjacent to the dust collecting chamber; and a valve device provided between the connection path and the dust collecting chamber, an opening/closing of the valve device allowing the dust collecting chamber to selectively communicate with the dust suction port or the dust exhaust port according to a pressure difference between the dust collecting chamber and the connection path.

The valve device may include a suction valve, which may be opened when dust is sucked through the dust suction port, and an exhaust valve, which may be opened when dust is exhausted through the dust exhaust port.

The robot cleaner system may further includes an air guide provided between the suction valve and the exhaust valve to define the dust collecting chamber and the connection path.

The exhaust valve may include a first valve member having a first side rotatably fixed and a second side pivotably rotated toward the connection path to open/close a path between the connection path and the dust collecting chamber.

The suction valve may include a second valve member having a first side rotatably fixed and a second side pivotably rotated toward the dust collecting chamber to open/close a path between the connection path and the dust collecting chamber.

The foregoing and/or other aspects are achieved by providing a robot cleaner, which docks with a docking station to exhaust dust to the docking station, including: a dust box to collect dust, wherein the dust box includes: a dust suction port sucking dust; a dust collecting chamber collecting dust introduced through the dust suction port; a dust exhaust port exhausting dust collected in the dust collecting chamber to the docking station; a connection path extending from the dust suction port to the dust exhaust port adjacent to the dust collecting chamber; and a valve device provided between the connection path and the dust collecting chamber such that the dust collecting chamber selectively communicates with the dust suction port or the dust exhaust port according to a pressure difference between the dust collecting chamber and the connection path. The valve device may include a suction valve, which may be opened when dust is sucked through the dust suction port, and an exhaust valve, which may be opened when dust is exhausted through the dust exhaust port. The exhaust valve may include a first valve member having a first side rotatably fixed and a second side pivotably rotated toward the connection path to open/close a path between the connection path and the dust collecting chamber. The suction valve may include a second valve member having a first side rotatably fixed and a second side pivotably rotated toward the dust collecting chamber to open/close a path between the connection path and the dust collecting chamber.

The exhaust valve may be provided at a lower portion of the dust collecting chamber, and the robot cleaner may further include a valve unit that opens the dust exhaust port when the robot cleaner docks with the docking station.

The foregoing and/or other aspects are achieved by providing a robot cleaner system, including a robot cleaner including: a first blower, a dust collecting chamber collecting dust when the first blower is operated, a connection path selectively communicating with the dust collecting chamber, and a valve device provided between the connection path and the dust collecting chamber, an opening/closing of the valve device allowing the connection path to selectively communicate with the dust collecting chamber; and a docking station including a second blower, the docking station receiving dust from the dust collecting chamber when the robot cleaner is docked with the docking station and the second blower is operated.

The valve device may be opened/closed according to a pressure difference between the dust collecting chamber and the connection path.

When the second blower is operated and suction force is applied to the connection path, a valve member of the valve device is closed to close the dust collecting chamber from the connection path.

BRIEF DESCRIPTION OF THE DRAWINGS

These and/or other aspects and advantages will become apparent and more readily appreciated from the following description of the embodiment, taken in conjunction with the accompanying drawings of which.

DETAILED DESCRIPTION OF THE EMBODIMENT

Figure 1:
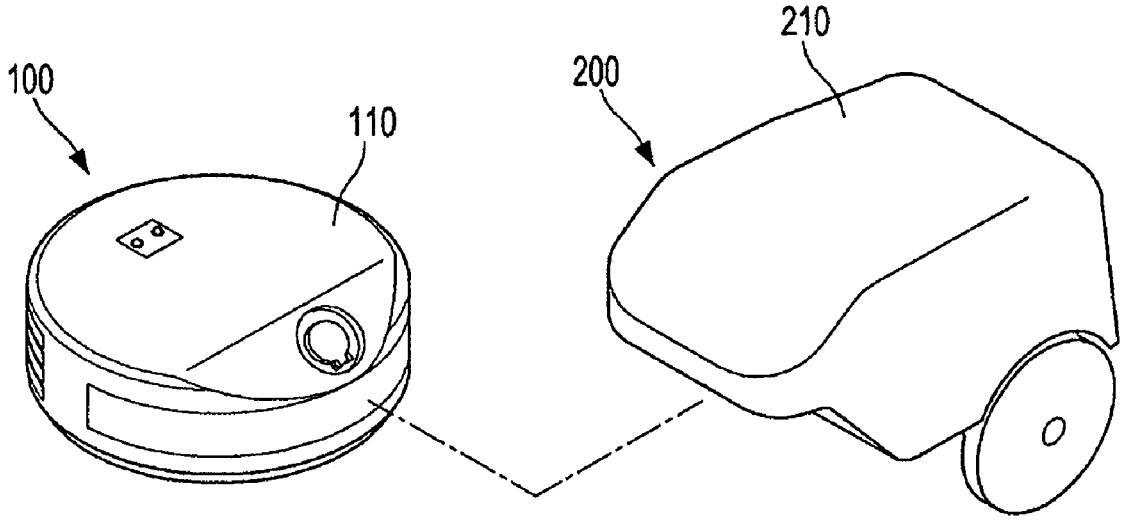
FIG. 1 is a perspective view showing an external appearance of a robot cleaner system according to an embodiment.

Reference will now be made in detail to the embodiment, examples of which are illustrated in the accompanying drawings, wherein like reference numerals refer to the like elements throughout. The embodiment is described below to explain the present invention by referring to the figures.

Figure 2:
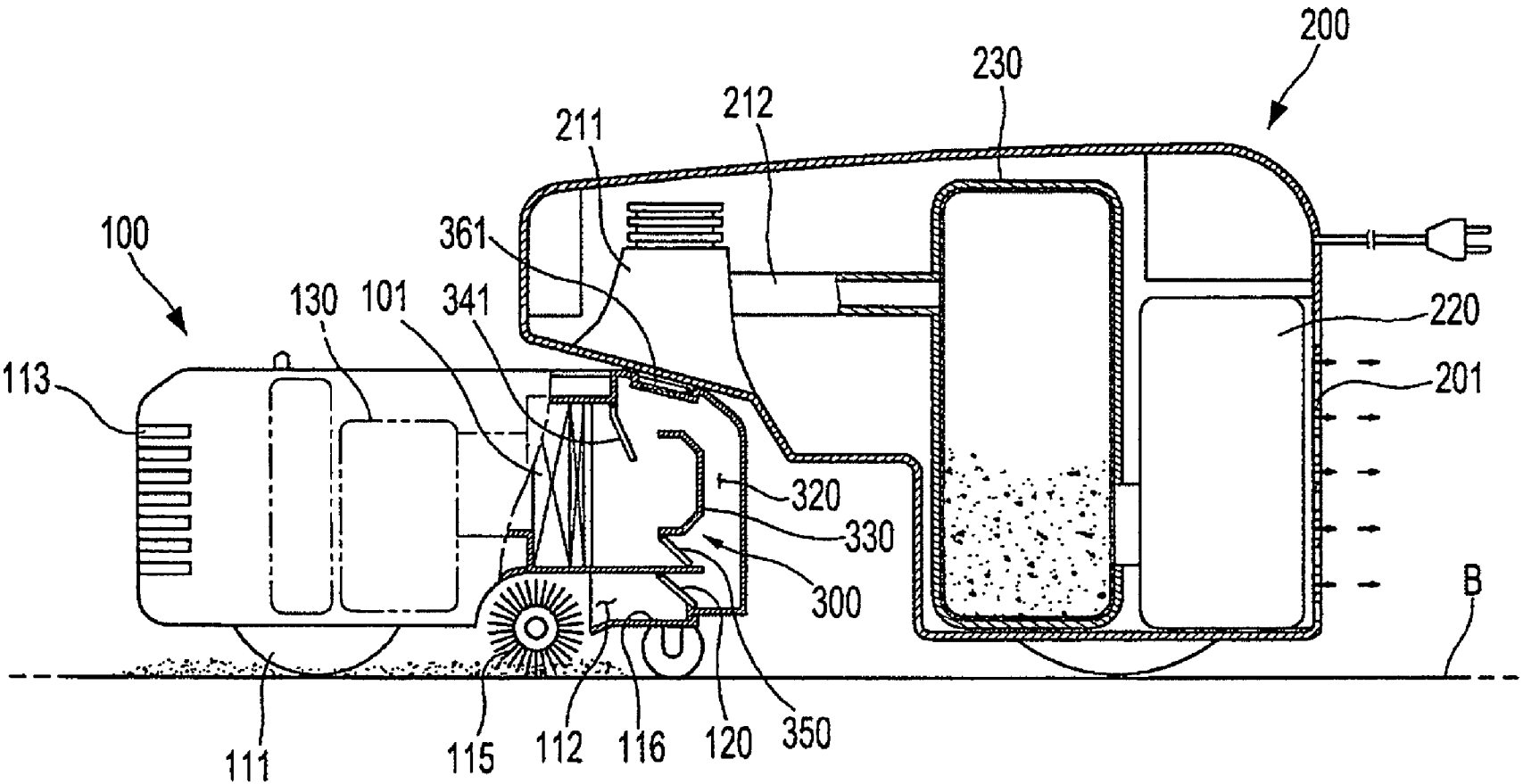
FIG. 2 is a partial sectional view showing an internal structure of a robot cleaner system shown in FIG. 1 in a state in which a robot cleaner docks with a docking station.
Figure 3:
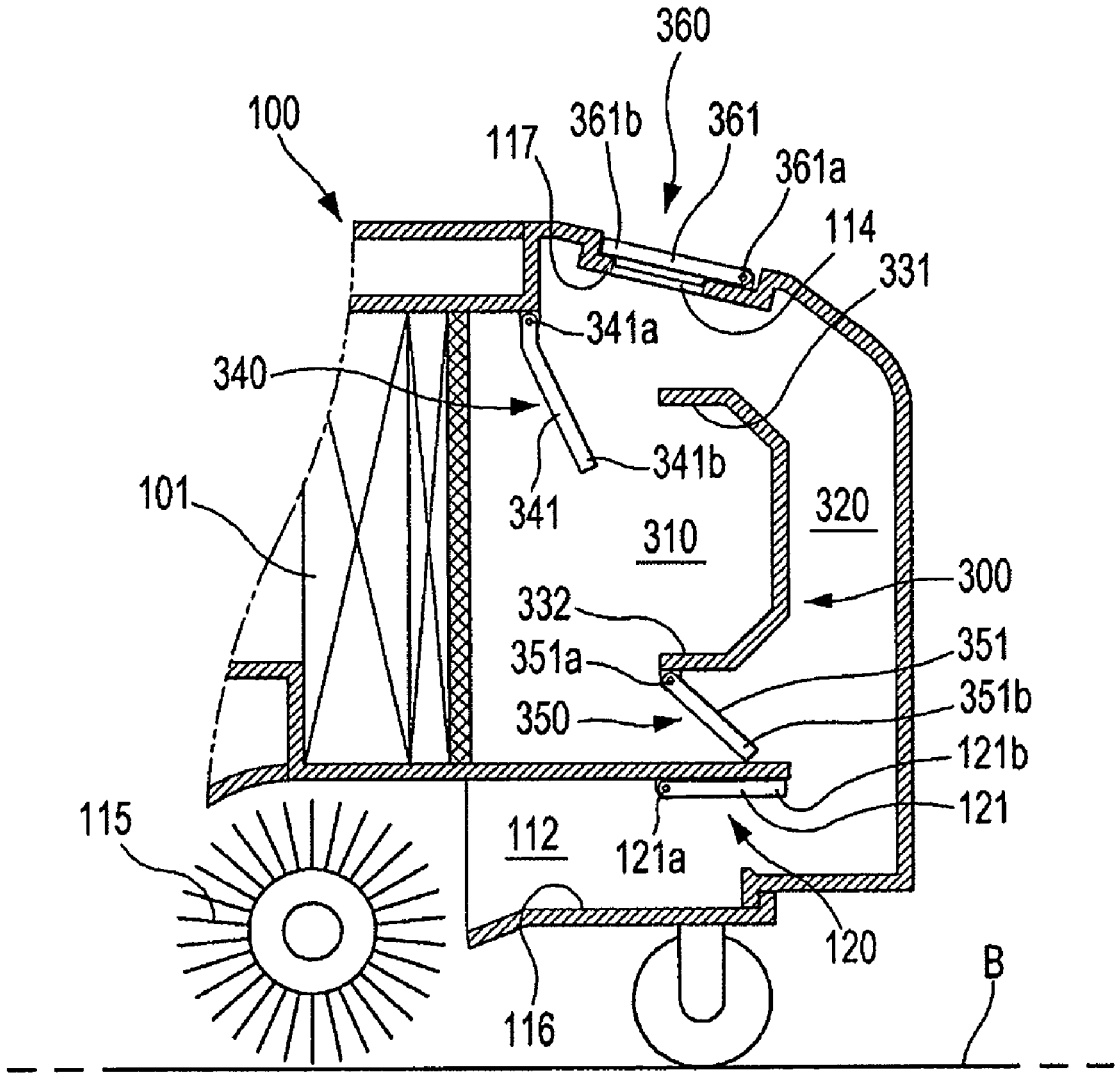
FIG. 3 is a sectional view showing a fluid path formed in a robot cleaner shown in FIG. 1 when the robot cleaner sucks dust.
Figure 4:
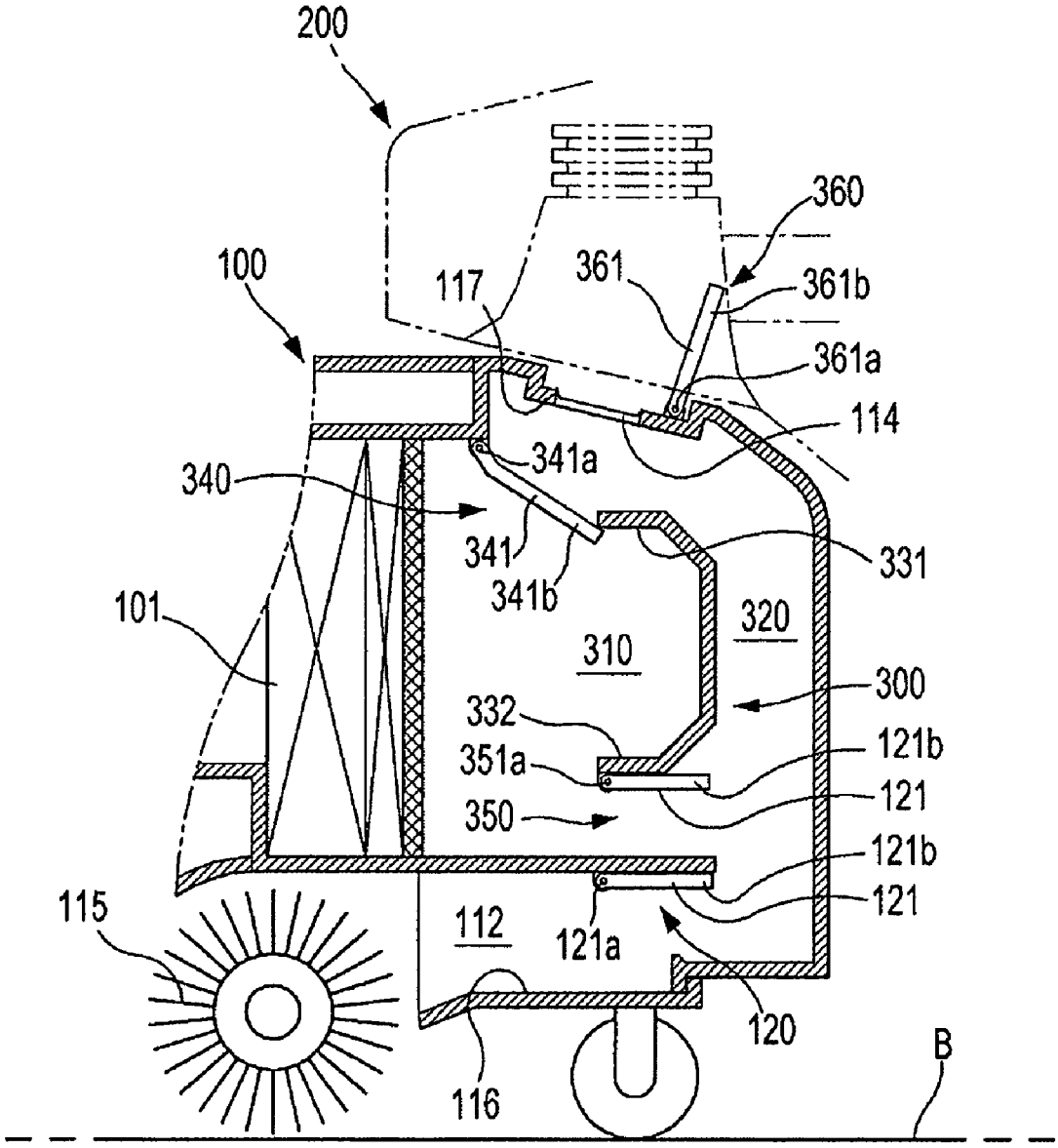
FIG. 4 is a partial sectional view showing a fluid path formed in a robot cleaner shown in FIG. 1 when the robot cleaner exhausts dust to a docking station.

FIG. 1 is a perspective view showing an external appearance of a robot cleaner system according to an embodiment, FIG. 2 is a partial sectional view showing an internal structure of a robot cleaner system shown in FIG. 1 in a state in which a robot cleaner docks with a docking station, FIG. 3 is a sectional view showing a fluid path formed in a robot cleaner shown in FIG. 1 when the robot cleaner sucks dust, and FIG. 4 is a partial sectional view showing a fluid path formed in a robot cleaner shown in FIG. 1 when the robot cleaner exhausts dust to a docking station.

As shown in FIGS. 1 through 4, the robot cleaner system according to the embodiment includes a robot cleaner 100 having a robot body 110 and a first dust box 300 installed in the robot body 110 to collect dust introduced into the robot body 100, and a docking station 200 that removes dust by sucking dust stored in the first dust box 300 when the robot cleaner 100 docks with the docking station 200.

The robot cleaner 100 automatically moves on a floor bottom to clean the floor bottom. If dust has collected in the first dust box 300 to a predetermined level, the robot cleaner 100 returns to the docking station 200 to exhaust dust.

As shown in FIG. 2, the robot cleaner 100 has a first blower 130 installed in the robot body 110 to generate suction force to suck dust. A filter 101 is disposed between the first blower 130 and the first dust box 300 in order to filter dust from air, thereby preventing dust from being introduced into the first blower 130.

The first blower 130 includes a suction motor and a blowing fan which is rotated by the suction motor. In addition, a sensor (not shown) is installed in the robot body 110 to detect an amount of dust collected in the first dust box 300.

A pair of driving wheels 111 is installed at a lower portion of the robot body 110 to allow the robot cleaner 100 to move. The driving wheels 111 are selectively driven by a driving motor (not shown) such that the robot cleaner 100 can move in a predetermined direction to clean work.

The robot cleaner 100 has a dust suction port 112, which is formed at a lower portion of the robot body 110 to suck dust from a bottom B of a cleaning region, an air exhaust port 113 to exhaust air, which is sucked by the first blower 130, out of the robot body 110, and a dust exhaust port 114 formed on an upper surface of the robot body 110 to exhaust dust to the docking station 200 when the robot cleaner 100 docks with the docking station 200.

A brush 115 is rotatably installed adjacent to the dust suction port 112 to brush dust from the bottom B, and a suction path 116 is formed between the dust suction port 112 and the first dust box 300 such that the dust suction port 112 can communicate with the first dust box 300.

Meanwhile, as shown in FIG. 2, the docking station 200 includes a station body 210, a second blower 220 installed in the station body 210 to generate suction force to suck dust, and a second dust box 230 provided in the station body 210 to collect dust therein.

The second blower 220 includes a fan motor (not shown) and a blowing fan (not shown) rotated by the fan motor. An air exhaust port 201 is formed in the docking station 200 in order to exhaust air sucked by the second blower 220 to the exterior.

A dust suction port 211 is formed in the station body 210 and corresponds with the dust exhaust port 114 of the robot cleaner 100 in order to suck dust from the robot cleaner 100. A dust suction path 212 is formed between the dust suction port 211 and the second dust box 230. Therefore, when the robot cleaner 100 docks with the docking station 200, the dust exhaust port 114 is adjacent to the dust suction port 211 to communicate with the dust suction port 211.

Meanwhile, the first dust box 300 is formed in the robot cleaner 100 in order to collect dust therein during the cleaning process. Fluid paths and valve devices are provided in the first dust box 300 in order to allow dust to be introduced into the robot cleaner 100 through the dust suction port 112 during the cleaning mode of the robot cleaner 100 and to exhaust dust to the docking station 200 through the dust exhaust port 114 when the robot cleaner 100 docks with the docking station 200.

Hereinafter, the structure of the first dust box 300 will be described in more detail. A dust collecting chamber 310 is formed at one side of the first dust box 300 to receive and collect dust therein. One side of the dust collecting chamber 310 communicates with both the filter 101 and the first blower 130. The dust exhaust port 114 is provided at an upper portion of the first dust box 300 and the suction path 116 is formed at a lower portion of the first dust box 300 to suck dust from the exterior.

A connection path 320 is formed between the suction path 116 and the dust exhaust port 114. An air guide 330 and a valve device are provided between the dust collecting chamber 310 of the first dust box 300 and the connection path 320 to define two space sections in the first dust box 300.

The valve device includes a suction valve 340 and an exhaust valve 350. The air guide 330 is provided between the suction valve 340 and the exhaust valve 350. When the robot cleaner 100 is in a cleaning mode, the suction valve 340 opens the space between the connection path 320 and the dust collecting chamber 310 to allow dust to be collected in the dust collecting chamber 310 through the dust suction port 112 and the connection path 320. In contrast, when the robot cleaner 100 docks with the docking station 200 to exhaust dust to the docking station 200, the suction valve 340 closes the space between the connection path 320 and the dust collecting chamber 310.

Different from the suction valve 340, the exhaust valve 350 is maintained in a closed state when dust is sucked through the dust suction port 112 and is maintained in an opened state when dust is exhausted to the docking station 200 in a state in which the robot cleaner 100 docks with the docking station 200.

The exhaust valve 350 and the suction valve 340 are opened/closed when sucking/exhausting dust due to a pressure difference between the dust collecting chamber 310 and the connection path 320. Such an opening/closing operation is achieved by first and second valve members 351 and 341, which are pivotably moved about one side end portion thereof.

In the case of the suction valve 340, an upper end portion of the second valve member 341 is fixed to an upper portion of the first dust box by a pivot pin 341*a*, and a lower end portion 341*b* of the second valve member 341 is pivotably rotated about the pivot pin 341*a*. When the lower end portion 341*b* of the second valve member 341 makes contact with an upper end portion 331 of the air guide 330, the path between the connection path 320 and the dust collecting chamber 310 is closed. Since the upper end portion of the second valve member 341 is fixed to the upper end portion of the first dust box by the pivot pin 341*a* and the upper end portion 331 of the air guide 330 is located adjacent to one side of the second valve member 341, the suction valve 340 is opened when there is no pressure difference between the dust collecting chamber 310 and the connection path 320 (normal state) and when dust is sucked into the dust collecting chamber 310 caused by a suction force of the first blower 130. In the docking state, if the second blower 220 of the docking station 200 operates to apply suction force to the connection path 320, the second valve member 341 is pivotably rotated about the pivot pin 341*a* due to air flow flowing forward to the connection path 320 from the dust collecting chamber 310, so that the lower end portion 341*b* of the second valve member 341 moves up and makes contact with the air guide 330. Thus, the path between the dust collecting chamber 310 and the connection path 320 is closed.

The structure and operation of the exhaust valve 350 are basically identical to those of the suction valve 340. If the suction valve 340 is opened, the exhaust valve 350 is closed. In addition, if the suction valve 340 is closed, the exhaust valve 350 is opened.

An upper end portion of the first valve member 351 is coupled to a lower end portion 332 of the air guide 330 by means of a pivot pin 351*a*. As a lower end portion 351*b* of the first valve member 351 makes contact with a bottom of the dust collecting chamber 310, the path between the dust collecting chamber 310 and the connection path 320 is closed. When the first valve member 351 is pivotably rotated about the pivot pin 351*a*, the lower end portion 351*b* of the first valve member 351 makes contact with the bottom of the dust collecting chamber 310, so that the rotation of the first valve member 351 toward the dust collecting chamber 310 may be limited.

Thus, in the normal state in which there is no pressure difference between the dust collecting chamber 310 and the connection path 320, or when dust is sucked into the dust collecting chamber 310 caused by a suction force of the first blower 130, the first valve member 351 is maintained in the closed state. In addition, in the docking state, if the second blower 220 of the docking station 200 operates to apply a suction force to the connection path 320, the first valve member 351 is pivotably rotated about the pivot pin 351*a* due to air flow flowing forward to the connection path 320 from the dust collecting chamber 310, so that the lower end portion 351*b* of the first valve member 351 moves upward. Thus, the path between the dust collecting chamber 310 and the connection path 320 is opened.

The exhaust valve 350 is located below the suction valve 340, i.e., the exhaust valve 350 is installed at the lower portion of the dust collecting chamber 310. Since dust is primarily collected in the lower portion of the dust collecting chamber 310, if the lower portion of the dust collecting chamber 310 is opened when dust collected in the dust collecting chamber 310 is exhausted to the docking station, dust can be effectively exhausted.

Meanwhile, in the cleaning mode of the robot cleaner 100, suction force is applied to the connection path 320. At this time, if the dust exhaust port 114 is open, loss of suction force occurs at the dust suction port 112. For this reason, a valve unit 360 is installed in the dust exhaust port 114. Similar to the suction valve 340 and the exhaust valve 350, the valve unit 360 includes a fourth valve member 361, which is pivotably rotated about a pivot pin 361*a* provided at one side of the fourth valve member 361 in order to open/close the connection path 320 relative to the exterior. When the robot cleaner 100 is in a cleaning mode or a normal state, a lower end portion 361*b* of the fourth valve member 361 makes contact with a stepped portion 117 formed at the upper portion of the first dust box 300, thereby closing the dust exhaust port 114. In addition, when suction force is applied to the dust suction force due to the operation of the docking station 200, the fourth valve member 361 opens the dust exhaust port 114. A check valve 120 is installed in the suction path 116. The check valve 120 includes a third valve member 121 provided at one side thereof with a pivot pin 121*a*. The third valve member 121 is pivotably rotated about the pivot pin 121*a* to open/close the suction path 116.

Similar to the first valve member 351 of the exhaust valve 350, an upper end portion of the third valve member 121 is coupled to the suction path 116 by the pivot pin 121*a* and a lower end portion 121*b* of the third valve member 121 makes contact with a lower portion of the suction path 116 such that the third valve member 121 can be closed in the normal state, thereby preventing dust from flowing back. In addition, the third valve member 121 is opened in the cleaning mode in which suction force is applied to the connection path 320, or when dust collected in the dust collecting chamber 310 is exhausted.

Hereinafter, the process of collecting dust using the robot cleaner 100 of the robot cleaner system according to the present embodiment and the process of transferring dust collected in the first dust box 300 to the second dust box 230 will be described in detail.

First, the process of collecting dust in the first dust box 300 will be explained. If the first blower 130 operates in the cleaning mode of the robot cleaner 100, suction force is applied to the dust collecting chamber 310, so that the suction valve 340 is opened and the exhaust valve 350 is closed. Thus, a fluid path extending from the suction path 116 to the dust collecting chamber 310 through the connection path 320 is formed in the robot cleaner 100. Accordingly, suction force is applied to the dust suction port 112, so that the check valve 120 is opened.

Therefore, dust is sucked due to suction force applied to the dust suction port 112 and then is collected in the dust collecting chamber 310 through the suction path 116, the connection path 320 and the suction valve 340.

Hereinafter, the process of transferring dust collected in the dust collecting chamber 310 to the second dust box 230 will be explained. If the second blower 220 operates in a state in which the robot cleaner 100 docks with docking station 200, the valve unit 360 of the dust exhaust port 114 is opened due to suction force applied thereto, so that suction force is applied to the connection path 320.

Such suction force opens the exhaust valve 350, so that the dust collecting chamber 310 communicates with the connection path 320. In addition, the check valve 120 of the suction path 116 is also opened due to such suction force, so that external air is introduced through the suction port 112.

At this time, air introduced into the dust collecting chamber 310 through the filter 101 is discharged to the connection path 320 together with dust collected in the dust collecting chamber 310. At the same time, dust remaining in the suction path 116 is also introduced into the connection path 320 together with air which is introduced through the dust suction port 112, so that dust is collected in the second dust box 230 through the dust suction port 211 of the docking station 200 and the dust exhaust path 212.

As described above, according to the present embodiment, in the cleaning mode, the robot cleaner represents superior suction efficiency when collecting dust in the first dust box. In addition, in the docking state, the robot cleaner can effectively exhaust dust collected in the first dust box to the docking station.

Further, according to the present embodiment, the upper portion of the robot cleaner docks with the docking station, so that a docking operation can be easily achieved. In addition, the robot cleaner can be used as a manual cleaner.

Although an embodiment has been shown and described, it would be appreciated by those skilled in the art that changes may be made in this embodiment without departing from the principles and spirit of the invention, the scope of which is defined in the claims and their equivalents.

What is claimed is:

1. A robot cleaner system, comprising:

a robot cleaner; and a docking station to receive dust collected in the robot cleaner, wherein the robot cleaner comprises:

a dust suction port to suck dust;

a dust collecting chamber to collect dust introduced through the dust suction port;

a dust exhaust port to exhaust dust collected in the dust collecting chamber to the docking station;

a connection path extending from the dust suction port to the dust exhaust port adjacent to the dust collecting chamber;

an air guide; and a valve device provided between the connection path and the dust collecting chamber, an opening/closing of the valve device allowing the dust collecting chamber to selectively intake dust from the dust suction port or exhaust dust to the dust exhaust port according to a pressure difference between the dust collecting chamber and the connection path, wherein the air guide and the valve device are provided between the dust collecting chamber and the connection path to define two space sections, and wherein the valve device includes a suction valve, which is opened when dust is sucked through the dust suction port, and an exhaust valve, which is opened when dust is exhausted through the dust exhaust port.

2. The robot cleaner system according to claim 1, wherein the air guide is provided between the suction valve and the exhaust valve to define the dust collecting chamber and the connection path.

3. The robot cleaner system according to claim 1, wherein the exhaust valve is provided at a lower portion of the dust collecting chamber.

4. The robot cleaner system according to claim 1, wherein the exhaust valve is closed when a pressure of the dust collecting chamber is lower than a pressure of the connection path.

5. The robot cleaner system according to claim 4, wherein the exhaust valve comprises a first valve member having a first side rotatably fixed and a second side pivotably rotated toward the connection path to open/close a path between the connection path and the dust collecting chamber.

6. The robot cleaner system according to claim 5, wherein the path between the connection path and the dust collecting chamber is closed in a normal state due to a weight of the first valve member.

7. The robot cleaner system according to claim 1, wherein the suction valve is closed when a pressure of the connection path is lower than a pressure of the dust collecting chamber.

8. The robot cleaner system according to claim 7, wherein the suction valve comprises a second valve member having a first side rotatably fixed and a second side pivotably rotated toward the dust collecting chamber to open/close a path between the connection path and the dust collecting chamber.

9. The robot cleaner system according to claim 8, wherein the path between the connection path and the dust collecting chamber is opened in a normal state due to a weight of the second valve member.

10. The robot cleaner system according to claim 1, wherein the robot cleaner further comprises a valve unit that opens the dust exhaust port when the robot cleaner docks with the docking station.

11. The robot cleaner system according to claim 1, wherein the robot cleaner further comprises a first dust box to collect dust, the dust collecting chamber, the connection path and the valve device being provided in the first dust box.

12. The robot cleaner system according to claim 1, wherein a check valve, which is opened when a suction force is applied to the connection path, is installed in the dust suction port to prevent dust from flowing back.

13. The robot cleaner system as claimed in claim 12, wherein the check valve comprises a third valve member, an upper portion of the third valve member being rotatably fixed so that the third valve member is able to close the dust suction port due to a weight thereof.

14. A robot cleaner system comprising:

a robot cleaner having a first dust box to collect dust; and a docking station to receive dust collected in the robot cleaner, wherein the first dust box comprises:

a dust suction port to suck dust;

a dust collecting chamber to collect dust introduced through the dust suction port;

a dust exhaust port to exhaust dust collected in the dust collecting chamber to the docking station;

a connection path extending from the dust suction port to the dust exhaust port adjacent to the dust collecting chamber;

an air guide; and a valve device provided between the connection path and the dust collecting chamber, an opening/closing of the valve device allowing the dust collecting chamber to selectively communicate with the dust suction port or the dust exhaust port according to a pressure difference between the dust collecting chamber and the connection path, wherein the air guide and the valve device are provided between the dust collecting chamber and the connection path to define two space sections, and wherein the valve device includes a suction valve, which is opened when dust is sucked through the dust suction port, and an exhaust valve, which is opened when dust is exhausted through the dust exhaust port.

15. A robot cleaner, which docks with a docking station to exhaust dust to the docking station, the robot cleaner comprising:

a dust box to collect dust, comprising:

a dust suction port to suck dust;

a dust collecting chamber to collect dust introduced through the dust suction port;

a dust exhaust port to exhaust dust collected in the dust collecting chamber to the docking station;

a connection path extending from the dust suction port to the dust exhaust port adjacent to the dust collecting chamber;

an air guide; and a valve device provided between the connection path and the dust collecting chamber, an opening/closing of the valve device allowing the dust collecting chamber to selectively communicate with the dust suction port or the dust exhaust port according to a pressure difference between the dust collecting chamber and the connection path, wherein the air guide and the valve device are provided between the dust collecting chamber and the connection path to define two space sections, and wherein the valve device includes a suction valve, which is opened when dust is sucked through the dust suction port, and an exhaust valve, which is opened when dust is exhausted through the dust exhaust port.

16. The robot cleaner according to claim 15, wherein the exhaust valve comprises a first valve member having a first side rotatably fixed and a second side pivotably rotated toward the connection path to open/close a path between the connection path and the dust collecting chamber.

17. The robot cleaner according to claim 15, wherein the suction valve comprises a second valve member having a first side rotatably fixed and a second side pivotably rotated toward the dust collecting chamber to open/close a path between the connection path and the dust collecting chamber.

18. The robot cleaner according to claim 15, wherein the exhaust valve is provided at a lower portion of the dust collecting chamber.

19. The robot cleaner according to claim 15, further comprising a valve unit that opens the dust exhaust port when the robot cleaner docks with the docking station.

20. A robot cleaner system, comprising:

a robot cleaner including:

a dust suction port to suck dust, a first blower, a dust collecting chamber collecting dust when the first blower is operated, a dust exhaust port to exhaust dust collected in the dust collecting chamber, a connection path selectively communicating with the dust collecting chamber, an air guide, and a valve device provided between the connection path and the dust collecting chamber, an opening/closing of the valve device allowing the connection path to selectively intake dust to and exhaust dust from the dust collecting chamber; and a docking station including a second blower, the docking station receiving dust from the dust collecting chamber when the robot cleaner is docked with the docking station and the second blower is operated, wherein the air guide and the valve device are provided between the dust collecting chamber and the connection path to define two space sections, and wherein the valve device includes a suction valve, which is opened when dust is sucked through the dust suction port, and an exhaust valve, which is opened when dust is exhausted through the dust exhaust port.

21. The robot cleaner system according to claim 20, wherein the valve device is opened/closed according to a pressure difference between the dust collecting chamber and the connection path.

22. The robot cleaner system according to claim 21, wherein when the second blower is operated and suction force is applied to the connection path, a valve member of the valve device is closed to close the dust collecting chamber from the connection path.

* * * * *